US009776191B2

(12) United States Patent
Schwelling

(10) Patent No.: US 9,776,191 B2
(45) Date of Patent: Oct. 3, 2017

(54) METHOD AND DEVICE FOR SHREDDING SHEET-SHAPED MATERIAL

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 504 days.

(21) Appl. No.: 14/493,000

(22) Filed: Sep. 22, 2014

(65) Prior Publication Data

US 2015/0083833 A1 Mar. 26, 2015

(30) Foreign Application Priority Data

Sep. 25, 2013 (DE) ..... 10 2013 015 968

(51) Int. Cl.
*B02C 18/00* (2006.01)
*B02C 18/22* (2006.01)

(52) U.S. Cl.
CPC ..... *B02C 18/2283* (2013.01); *B02C 18/0007* (2013.01)

(58) Field of Classification Search
USPC ..... 241/225
See application file for complete search history.

(56) References Cited

U.S. PATENT DOCUMENTS 4,232,860 A * 11/1980 Brown ..... B65H 3/063 241/225
4,817,877 A * 4/1989 Itoh ..... B02C 18/0007 241/225
7,422,171 B2 * 9/2008 Huang ..... B02C 18/2283 241/225
7,658,342 B2 2/2010 Chang
8,146,845 B2 4/2012 Chen
8,403,246 B2 * 3/2013 Seo ..... B02C 18/0007 241/225

(Continued)

FOREIGN PATENT DOCUMENTS

AU 3370501 8/2001
CN 2080424 7/1991
CN 2907901 6/2007

(Continued)

OTHER PUBLICATIONS

State Intellectual Property Office of the People's Republic of China, Search Report for Chinese Patent Application No. 201410756157.7, dated Apr. 10, 2016, 2 pages.

(Continued)

*Primary Examiner* — Faye Francis
(74) *Attorney, Agent, or Firm* — Kolisch Hartwell, P.C.

(57) ABSTRACT

The invention relates to a method for shredding sheet-shaped material, preferably for shredding stacked sheets of paper. In addition, the invention relates to a device for performing said method.

According to the method according to the invention, a stack of paper is placed onto a support, the sheets are grasped individually from the stack and, whilst realizing a sheet loop, are guided one after another through a through-opening in the support to a cutting system, and are shredded in the cutting system, wherein, when the loops are formed, the sheets are merely deformed elastically and consequently reversibly such that by realizing a free end each sheet loop is opened again before it reaches the cutting system, and is cut up, unfolded, into regular particles over its entire length.

20 Claims, 6 Drawing Sheets

(56) References Cited

U.S. PATENT DOCUMENTS 8,727,255 B2 * 5/2014 Kim ..... B02C 18/0007
241/100

FOREIGN PATENT DOCUMENTS

| | | |
|---|---|---|
| CN | 201603594 | 10/2010 |
| DE | 112010005685 | 3/2013 |
| JP | 5146699 | 6/1993 |
| JP | 2011011197 | 1/2011 |
| WO | 0154820 | 8/2001 |
| WO | 2011162428 | 12/2011 |

OTHER PUBLICATIONS

European Patent Office, Search Report for European Patent Application No. 14186245, dated Feb. 23, 2015, 2 pages.

* cited by examiner 27
2.n
3.3
3.2
2.3
2.2
3
V 28
4
6
1
3.1
L 2
2.1
M
8.2
A2
7.2
5.2
12
17
18
9
10
2.1
11
11
L 1
16
A1
8.1
7.1
5.1
3.3
P1
P2
P3
P4

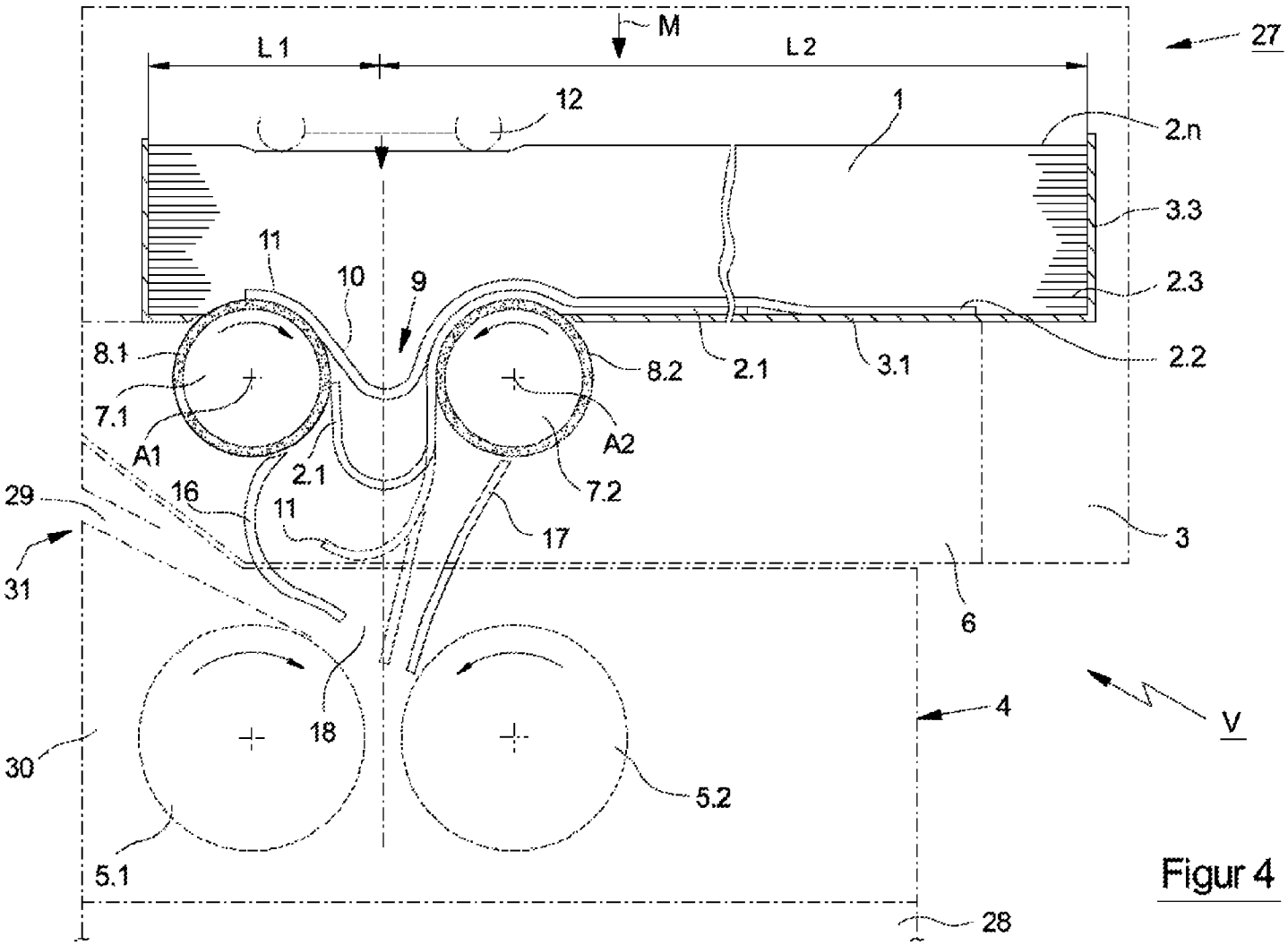
Figur 4

METHOD AND DEVICE FOR SHREDDING SHEET-SHAPED MATERIAL

The invention relates to a method for shredding sheet-shaped material, preferably for shredding stacked sheets of paper. In addition, the invention relates to a device for performing said method.

Methods and devices of the aforementioned type are known, for example, in connection with the destruction of documents. In this case, sheets of paper are cut up by means of a cutting system into strips or, in the case of more stringent demands for the level of destruction, into small and very small particles. In different methods of operation, the sheets are either removed individually from the stack starting with the uppermost sheet and are supplied one after another to the cutting system, or, starting from the bottommost sheet of the stack, are pulled through a feed opening in a stack support and introduced into the cutting system. In order to obtain a quicker turnaround of larger sheet numbers through the cutting system, the sheets following one after another can overlap in part.

The invention described below relates to such methods and devices where the shredding starts with the bottommost sheet of the stack.

With reference to this, DE 100 03 218 B4 describes a method for destroying sheet material which is present in stacked form and a device for carrying out said method. In this connection, the sheet lying at the bottom of the stack in each case is grasped in its central region from below through a through-opening, is folded in a V-shaped manner and with the fold in front is introduced into the cutting system. The sheets are cut up individually one after another without any mutual overlapping.

The document shredder described in DE 11 2010 005 685 T5 comprises two paper supporting parts of different lengths, between which a through-opening is realized for the sheet lying in each case at the bottom of the sheet stack. On account of the unequal lengths of the supporting surfaces for the stack, the sheet is grasped not centrally but asymmetrically to its center region, is folded in a V-shaped manner and, with the folded region in front, is introduced into the cutting system. The sheets are grasped and supplied to the cutting system in an individual manner, mutual overlap being provided in such manner that the shredding of one or several subsequent sheets starts even before the shredding of a preceding sheet is terminated.

With reference to the destroying of information carriers produced from paper, different shredding stages are prescribed according to German and also international standards depending on the security requirement, a certain admissible cutting width or particle size being defined for each stage. Whereas according to current rules the lowest shredding stage, which corresponds to the least important data security level, allows a particle area on shredding cross cut of 1000 $mm^2$, in the case of the maximum shredding stage striven for according to international standards, which meets intelligence security requirements, the particle area must be no more than 5 $mm^2$.

In this regard, the disadvantage of the methods and devices for destroying or shredding information carriers which have been cited above as prior art is that the sheets pass into the cutting system with a region folded to form a V shape in front, which results, during the shredding of the folded region, in particles with an inadmissibly large particle area, in the majority of cases a particle area that is twice the size. As a result, the predefined shredding stage or security is not achieved.

Proceeding from here, the object underlying the invention is to provide a method which eliminates the disadvantages of the prior art and ensures each sheet will be shred into the particle area which corresponds to the predefined shredding stage. A further object of the invention consists in proposing a device for performing said method.

In the case of a method for shredding sheets, preferably sheets of paper, which are present in a stack, where

- first of all a stack of sheets is placed onto a support,
- the sheets, by forming a sheet loop, are pulled individually one after another through a through-opening in the support,
- the singled-out sheets are conveyed one after another to a cutting system and
- are cut up by means of the cutting system to form particles, it is provided according to the invention that when the loop is being formed the sheets are merely deformed elastically and consequently reversibly,
- by realizing a free sheet end each sheet loop is opened before it reaches the cutting system, and
- whilst continuing the conveying of the sheets, the sheets are introduced into the cutting system with the sheet ends in front, wherein
- the sheet ends are grasped by the cutting system and pulled into the cutting system such that each of the sheets, unfolded, is cut up into particles over its entire length.

The stack of sheets is preferably deposited onto a support surface of the support which is aligned in an advantageous manner perpendicularly to the direction of gravity, and the grasping of the bottommost of the sheets of the stack in each case and the passage thereof through the through-opening is performed by means of counter rotating conveying rollers.

In a further preferred realization variant of the method, the force with which the stack of paper sheets rests on the conveying rollers is increased, for example by means of weights placed on the sheet stack in order to increase the static friction between the circumferential faces of the conveying rollers and the sheet contacted by the conveying rollers in each case such that the static friction in each stage of the destruction of the stack is greater than the static friction between the sheets themselves.

The sheet loop is opened by the contact between the sheet and one of the conveying rollers being terminated and, as a result, a sheet end being released such that on account of the release of the tension of the sheet material made possible by this, the sheet end that has become free is stretched. The stretching of the sheet material—in particular in the case of a support surface which is aligned perpendicularly to the direction of gravity—is supported by the action of gravity.

In an advantageous manner, the passage and the loop forming of the loop of the following sheet has already been started when the preceding sheet has reached the cutting system with its free end and is pulled into said cutting system. Thus, several sheets, offset in relation to one another by a certain length in the conveying direction, are shred at the same time in an economically efficient manner.

According to a further realization variant, the conveying speed of the conveying rollers is slower than the conveying speed of the cutting rollers of the cutting system. Consequently a swelling up or a pushing together of the conveyed paper sheets is avoided in the region of the conveying section which leads to the cutting system after the conveying rollers. Said swelling up can be a wave-shaped deforming of the portion of a supplied paper sheet which is still located in each case in front of the cutting system or even a fold formation. Wave-shaped deforming or a fold formation on one or several paper sheets would—when observed relatively—narrow the cross section of the feed region leading toward the cutting system. Such a constriction could cause a jam in the sheet feed and consequently a fault in the operating sequence.

The object underlying the invention is additionally achieved with a device for shredding sheets, for example sheets of paper, which are present in a stack, as a result of cutting them up preferably into particles. The device is realized for performing the above-mentioned method steps and includes:

a support for a stack of sheets, a cutting system, consisting of two counter rotating cutting rollers, a sheet-grasping and sheet-conveying device, realized for grasping the sheets individually from the stack and for conveying the singled-out sheets toward the cutting system, wherein the sheet-grasping and sheet-conveying device comprises two counter rotating conveying rollers, the circumferential faces of which are in entraining contact in a positive locking or frictional locking manner with the next sheet of the stack through a through-opening which is present in the support, and wherein the releasing of said sheet from the stack and the passage thereof through the through-opening is provided whilst forming a sheet loop which extends toward the cutting system.

It is characterized according to the invention in that as a result of a certain predefined spacing between the two conveying rollers, merely elastic, reversible deforming of the sheets is the result of the forming of the loop, and on account of a predefined asymmetrical position of the through-opening relative to the sheet ends in the stack, the entraining contact between a first conveying roller and the sheet is terminated, whilst the second conveying roller is still in entraining contact with the sheet such that one end of the sheet is free and the elastic deformation is reversed before the sheet loop reaches the cutting system, and the cutting system is positioned relative to the conveying direction of the free sheet end such that said free sheet end passes between the cutting rollers, wherein the sheet end is grasped by the cutting system and pulled into the cutting system such that the sheet is cut up into particles over its entire length.

In the case of the term "elastic deforming", it is assumed in the sense of the present invention that this occurs for materials which, on account of their characteristics, are deformed under load, material stresses occurring, and once the load has terminated the material reforms into its original shape on account of said stresses. This means that there is only elastic deforming during the period in which a corresponding load acts on the material. If, in contrast, the load and the stresses caused as a result in the material are so large that there is an irreversible change in shape, the term "plastic deforming" is applicable.

A connection between two connection partners is said to be a frictional locking connection in the sense of the present invention when a normal force, which prevents mutual displacement and there is static friction as a result, acts on the faces contacting one another. If one of the connection partners is moved, said contact causes the other connection partner to be entrained, for as long as the counter force brought about by the static friction is not exceeded. In the case of a positive locking connection, in contrast, the connection partners are interlocked, this means that entrainment forces do not act normal to the surfaces of the connection partner but at an angle, for example at right angles thereto.

The device according to the invention is realized in an advantageous manner—however not in a restricting manner—such that the support surface for the sheet stack is preferably aligned at right angles to the direction of gravity such that the reversing of the elastic deformation as a result of the tension of the sheet material being released is supported by gravity acting on the free sheet end. Consequently, it is ensured in a highly reliable manner that the sheet end, once it has been released from a first of the two conveying rollers, whilst the sheet, however, is conveyed further by means of the second conveying roller, passes into the cutting system, is grasped by the cutting system and as a result the entire sheet, once the other sheet end has also been released by the second conveying roller, is pulled in by the cutting system and cut up into regular particles.

As an alternative to this or also in addition to utilizing the gravitational force, guide elements for the sheet end can be provided in the spatial region between the sheet-grasping and sheet-conveying device and the cutting system, in the so-called feed region, in order to develop the running of the sheet end into the cutting system in an even more reliable manner. Said guide elements are arranged and formed for this purpose in such a manner that the reversing of the elastic deformation of the said portion of each sheet, quasi the swelling-up of the sheet end, is able to be effected or is supported in an unobstructed manner.

In a preferred development, the device according to the invention is provided with a third rotating conveying roller which is in entraining contact in a positive locking or frictional locking manner with the bottommost sheet of the stack in each case through a further opening which is present in the support, wherein the direction of rotation of the third conveying roller corresponds to the direction of rotation of the second conveying roller which is arranged between the first and third conveying roller. In this case, the spacing between the rotational axes of the first and of the third conveying roller, measured parallel to the support surface, is smaller than the length of the sheet. The diameters of the three conveying rollers are preferably the same size.

In an advantageous manner, the device according to the invention is provided with a device for increasing the force at which the sheet stack rests on the conveying rollers, wherein mechanical springs or, in a particularly preferred manner, bearing weights are provided to increase the force.

The conveying rollers are covered with a material which produces as high a coefficient of friction as possible in connection with the sheet material, for example with a soft-elastic material. The friction between the circumferential faces of the conveying rollers and the sheets is then greater than the friction between the sheets such that the singling-out of the sheets by detaching them from the stack is possible by means of the conveying rollers. As an alternative to this, the circumferential face of the conveying rollers can be realized with a high level of roughness such that, as a result, the static friction between the circumferential faces and the sheets is greater than between the sheets.

The invention is explained in more detail below by way of exemplary embodiments which, however, do not restrict the invention. The associated drawings, in schematic representation, are as follows:

FIG. 1 shows the representation of an embodiment of the device according to the invention;

FIG. 1*a* shows a development of the embodiment according to FIG. 1;

FIG. 1*b* shows further details of the embodiments according to FIG. 1 and according to FIG. 1*a;*

FIG. 4 shows a further development of the embodiments according to FIG. 1, according to FIG. 1*a*, according to FIG. 2 and according to FIG. 3.

Figure 1:
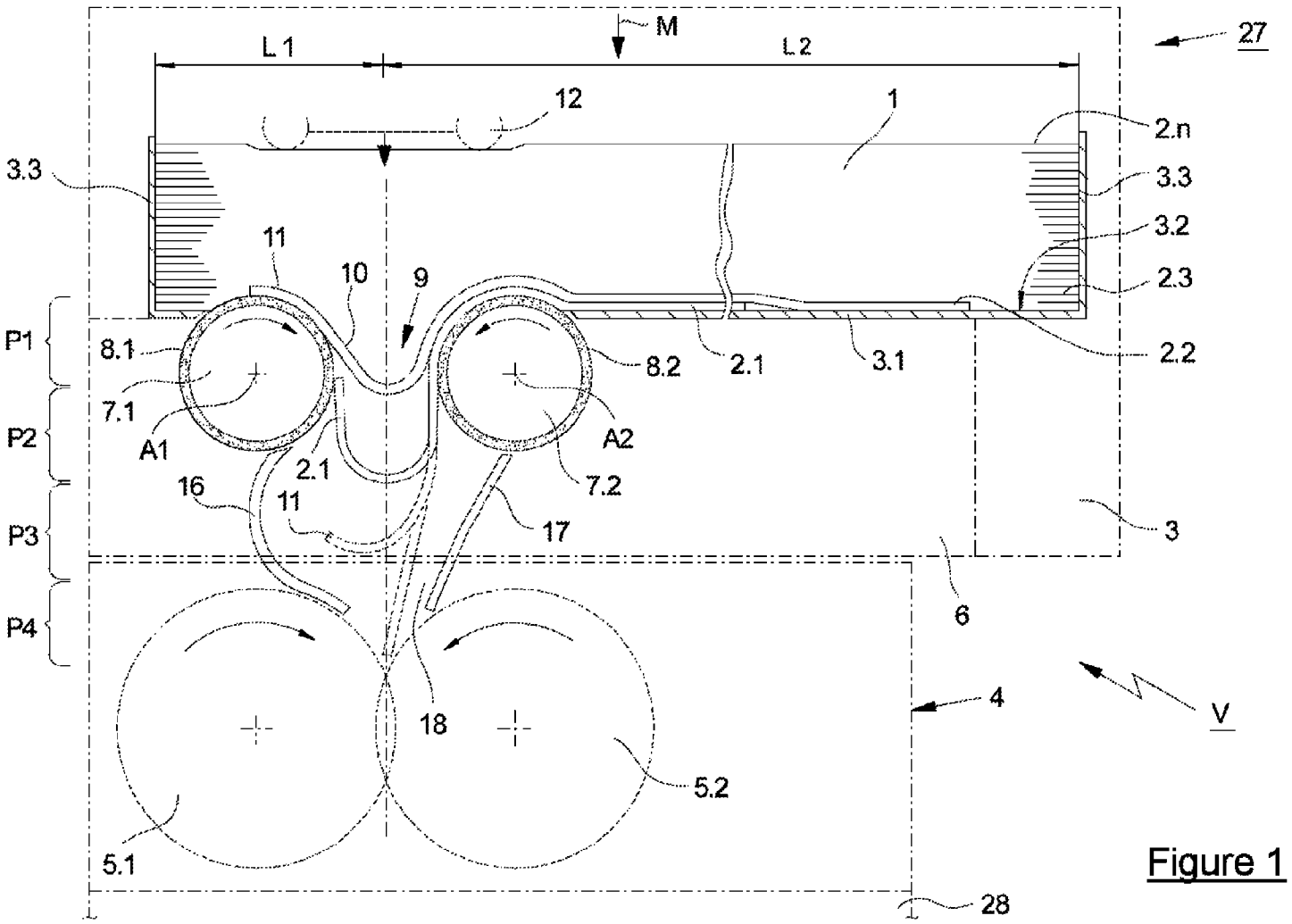

The reference numerals used in the Figures have the same meaning in each case even if they are not expressly named for each Figure in the description of the realizations.

Terms such as "left", "right", "up" or "down" are named in the Figures simply with reference to the representation; other positions can be produced in the actual arrangement in practice. In addition, it is pointed out that the Figures are not pure technical drawings, which is why shading and break-off lines are omitted in part. The relative dimensions can also deviate from reality.

The "V" device shown as an example in FIG. 1 is developed for shredding sheets 2.1, 2.2 . . . 2.*n*, preferably paper sheets of DIN A4 size, which are present in a stack 1. As can be seen, the "V" device includes a support 3 for the stack 1, a cutting system 4 with two counter rotating cutting rollers 5.1 and 5.2 as well as a sheet-grasping and sheet-conveying device 6 which is realized for grasping the sheets 2.1, 2.2 . . . 2.*n* individually from the stack 1 and for conveying the singled-out sheets toward the cutting system 4.

A collecting container 28 or a housing in which the collecting container 28 for the shredded product can be placed, is arranged beneath the cutting system 4.

According to one technical variant, the support 3 and the sheet-grasping and sheet-conveying device 6—when viewed structurally—are one technical assembly each which together form one operating unit of the "V" device, and that is the auto-feed unit 27.

The sheet-grasping and sheet-conveying device 6 comprises two counter rotating conveying rollers 7.1 and 7.2 which by way of their circumferential faces 8.1 or 8.2 reach through a through-hole 9 which is present in the bottom 3.1 of the support 3 and are thus is in contact with that one of the sheets 2.1, 2.2 . . . 2.*n* which is the nearest. In the situation shown this is the sheet 2.1.

The conveyor rollers 7.1 and 7.2 in FIG. 1 have associated therewith arrows which refer to the directions of rotation thereof; the rotation. The respective axis of the conveying rollers 7.1 and 7.2 is designated with the reference A1 or A2, the rotational axes.

The conveying rollers 7.1 and 7.2 are covered with a less hard material, preferably with rubber, for example with a Shore value of equal to or less than 50 A such that between the circumferential faces 8.1 or 8.2 and the bottom side of the sheet 2.1 which is contacted by the conveying rollers 7.1 and 7.2 there is a connection based on static friction with a higher coefficient of friction than between the sheets 2.1, 2.2 . . . 2.*n* themselves.

The previously described arrangement is realized in an expedient manner such that the sheet 2.1 is detached from the stack 1 as a result of the rotation of the conveying rollers 7.1 and 7.2 in opposite directions and the static friction, and is pulled through the through-opening 9 by forming a sheet loop 10 which extends toward the cutting system 4. In this case, the conveying rollers 7.1 and 7.2 convey the grasped region of the sheet 2.1 in opposite directions. As a result of this, the sheet material in said region is pushed together, it is deformed downward and the sheet loop 10 is formed which is subsequently pushed down through between the two conveying rollers 7.1 and 7.2.

Unlike in the prior art where the sheet material is folded plastically and irreversibly to form a V-shaped point in one method step and the sheet 2.1 is introduced into the cutting system with the V-shaped point in front, according to the invention a loop is formed merely up to an elastic, reversible deformation of the sheet material and the sheet loop 10 is subsequently opened such that the elastic deformation is reversed before the sheet loop 10 reaches the cutting system and the sheet 2.1 is introduced into the cutting system 4 by way of an unfolded free end 11. The aforementioned also applies to each further sheet 2.2 to 2.*n* following the sheet 2.1.

As is explained below, for this purpose the position of the through-opening 9 in the bottom 3.1 of the support 3 is arranged in the stack 1 in an asymmetrical manner with reference to the two ends on both sides of the sheets 2.1, 2.2. 2.*n*, and for the spacing a12 between the conveying rollers 7.1 and 7.2—see FIG. 1*b*—in dependence on the elasticity of the sheets 2.1, 2.2 . . . 2.*n* a certain measurement is predefined such that the elasticity limit is not exceeded when the loop is formed, but merely an elastic deformation is performed, and the static friction or the entraining contact between a first conveying roller 7.1 and the sheet 2.1 to be detached is already ended at a moment at which the second conveying roller 7.2 is still in entraining contact with the same sheet 2.1.

The asymmetrical arrangement of the through-opening 9 can be seen in FIG. 1 by way of the unequal lengths L1 and L2, measured up to the respective sheet ends.

The opening of the sheet loop 10, which is achieved in this manner and with this arrangement, results in the release of the sheet end 11 and in a stretching of the sheet 2.1 in the region of the free sheet end 11 on account of the release of the tension of the sheet material.

As can be seen additionally from FIG. 1, the cutting system 4 is positioned in relation to the conveying direction of the free sheet end 11 such that said free sheet end passes between the counter rotating cutting rollers 5.1 and 5.2, the sheet 2.1 being grasped at its free sheet end 11 by the cutting rollers 5.1 and 5.2, pulled into the cutting system 4 and is cut up into particles over its entire length.

FIG. 1 shows four selected sequence phases P1, P2, P3 and P4 of the grasping and of the passage of the sheet 2.1.

At the moment of sequence phase P1, the sheet 2.1—on account of the through-opening 9 being positioned asymmetrically with respect to the center M of the stack 1—has been grasped by way of its sheet end 11 by means of the conveying rollers 7.1 and 7.2 and the passage through the through-opening 9 has started with the sheet material deforming elastically.

When sequence phase P2 is reached, the contact or frictional connection between the conveying roller 7.1 and the sheet 2.1 is terminated and the sheet end 11 which has already been pulled through the through-opening 9 and is formed elastically into a sheet loop 10 is released.

In sequence phase P3, the sheet end 11 of the sheet 2.1 is released, it has already stretched in part due to the release of the tension whilst the conveying of the sheet 2.1 is continued just by way of the conveying roller 7.2.

Sequence phase P4 shows the now complete stretching of the sheet 2.1 in the region of its free sheet end 11. Here it is possible to see the positioning of the cutting system 4 relative to the free sheet end 11 such that as the sheet 2.1 continues to be conveyed by means of the conveying roller 7.2, the sheet end 11 passes between the cutting rollers 5.1 and 5.2.

At the same moment at which the sheet 2.1 reaches the sequence phase P2, the following sheet 2.2 has reached the sequence phase P1. When the sheet 2.1 reaches the sequence phase P3, at the same time the following sheet 2.2 is situated in sequence phase P2 and the sheet 2.3 following this one is situated in sequence phase P1. When the sheet 2.1 reaches the sequence phase P4, at the same time the following sheet 2.2 is situated in the sequence phase P3 and the sheet 2.3 following this one is situated in sequence phase P2.

The sheets 2.1, 2.2 . . . 2.*n* run through the sequence phases P1, P2, P3 and P4 at the schematically shown spacings in space and time and are cut up into particles over their entire length in the cutting system 4.

As shown above, the passage and the loop forming of the following sheet in each case is already started when the preceding sheet no longer forms a sheet loop 10, preferably when it reaches the cutting system 4 with its free sheet end 11 and is pulled into said cutting system. Thus, several sheets, offset with respect to one another by a certain length in the conveying direction, are shredded at the same time in an economically efficient manner. This is a further advantage of the invention compared to known methods and devices.

The design according to the invention of the "V" device allows for the number/quantity of sheets 2.1, 2.2 . . . 2.*n* conveyed at the same time toward the cutting system 4 to be able to be adjusted in a variable manner.

This can be effected according to one realization by adapting the conveying speed of the conveying roller 7.1 or of the conveying rollers 7.1 and 7.2 in a corresponding manner.

Figure 1A:
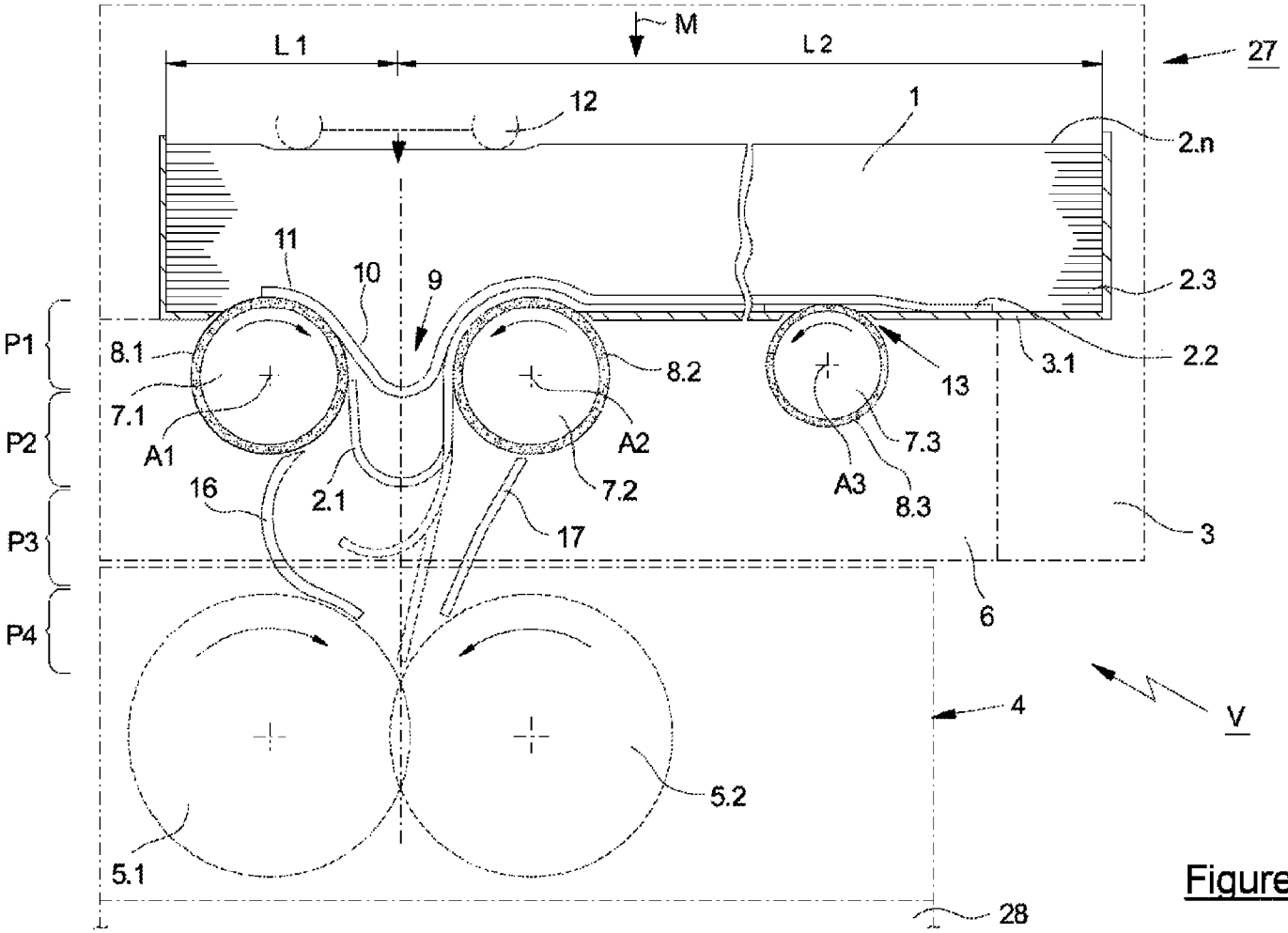
Figure 1B:
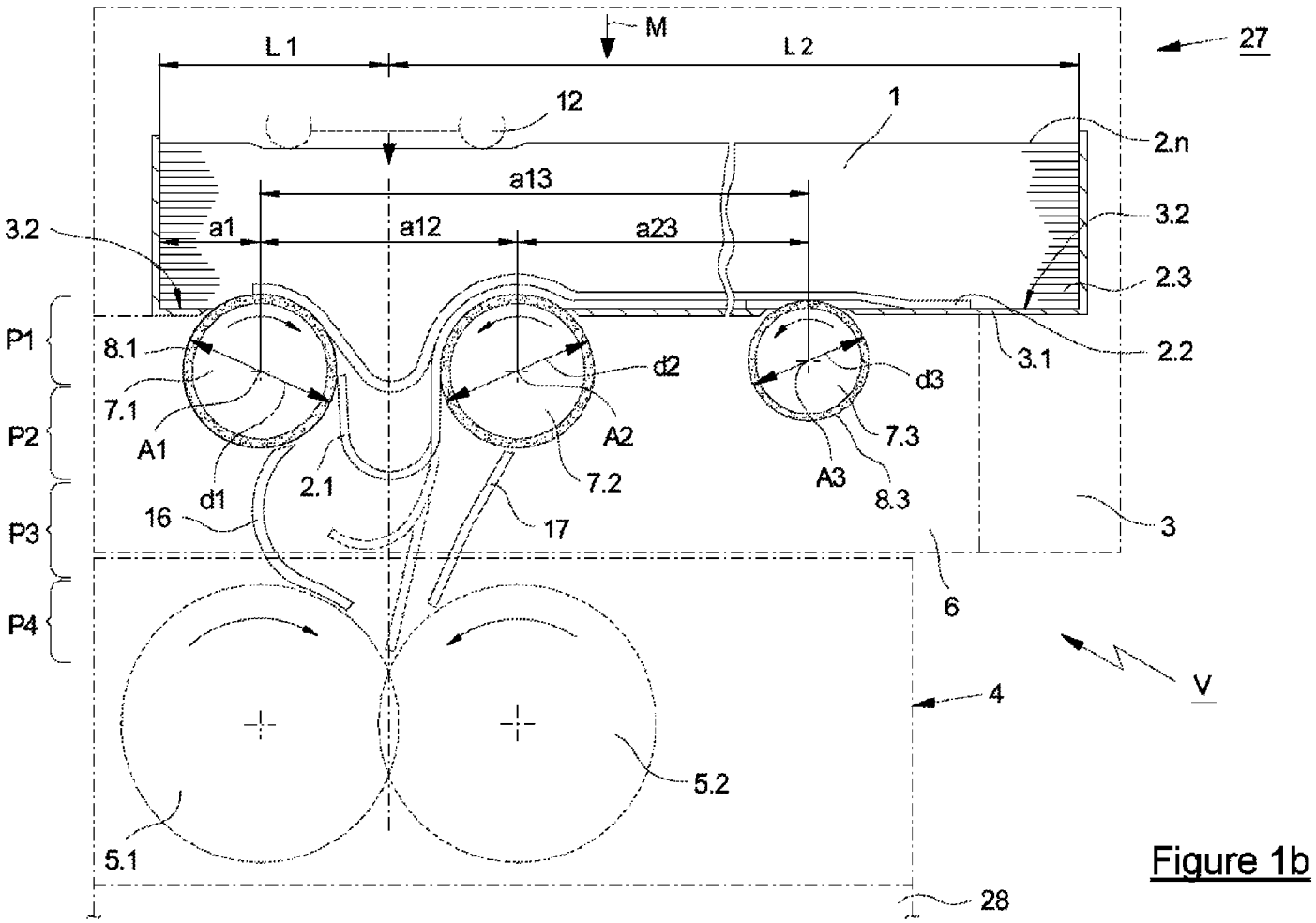

Another realization for achieving said development of the invention consists in that the length L1, see FIGS. 1 to 1*b*, is able to be adjusted in a variable manner. To this end, the relevant end-face wall 3.3 of the support 3 is arranged in an advantageous manner so as to be displaceable and lockable. In addition, a combination of said two realizations can also be effected.

At the start of the destruction of a stack 1, the bottommost sheet 2.1 is pressed with the weight of the stack 1 onto the conveying rollers 7.1, 7.2, 7.3, see also in FIG. 1*a*. As a result, said force decreases with every sheet 2.1, 2.2 . . . 2.*n* pulled in and from a certain number of sheets the contact force becomes so small that the frictional connection is too slight and the conveying of the paper is no longer able to take place in a reliable manner as intended. In order to counter this, bearing weights 12 are provided in a further development of the invention.

The bearing weights 12 are placed onto the stack 1 in the region of the through-opening 9 or of the first conveying roller 7.1 and the second conveying roller 7.2.

Here too, the device according to the invention differs from the prior art, where in comparable devices for increasing the force not weights but mechanical compression springs are utilized. The disadvantage of using springs is the dependence of the force generated on the spring path, as a result of which as the stack height becomes smaller the force and as a consequence the frictional connection also become smaller.

The support 3 is aligned with its support surface 3.2, which is provided on its bottom 3.1, for the sheets 2.1, 2.2 . . . 2.*n* preferably at right angles to the direction of gravity such that the stretching of the sheet material once the sheet loop 10 has been opened is supported by the effect of gravity.

FIG. 1*a* shows a development variant of the device according to FIG. 1, provided with a third rotating conveying roller 7.3. The conveying roller 7.3 is in entraining contact in a positive locking or frictional locking manner with the respectively next sheet of the stack 1, in this case shown by way of the sheet 2.1, through a further opening 13 which is present in the bottom 3.1 of the support 3, the direction of rotation of the conveying roller 7.3 corresponding to the direction of rotation of the conveying roller 7.2.

As has already been stated, in the aforementioned exemplary embodiments according to FIG. 1 and FIG. 1*a* frictional locking is provided in each case between the conveying rollers 7.1, 7.2 and 7.3. In order to ensure that the friction between the circumferential faces of the conveying rollers 7.1, 7.2, 7.3 and the sheets 2.1, 2.2 . . . 2.*n* is greater than between the sheets 2.1, 2.2 . . . 2.*n* themselves, the conveying rollers 7.1, 7.2, 7.3 are covered, as an example, with rubber or natural rubber which comprises a low degree of hardness. If the coefficient of friction between the sheets 2.1, 2.2 . . . 2.*n* is 0.5, for example, the coefficient of friction between the conveying rollers 7.1, 7.2, 7.3 and the respective sheet 2.1, 2.2 . . . 2.*n* should be 0.8. I.e. in all cases the coefficient of static friction between each conveying roller and the respective sheet should be greater than between two sheets.

A device according to FIG. 1 or according to FIG. 1*a* is provided, for example, for destroying standard size DIN A4 sheets 2.1, 2.2 . . . 2.*n* and in dependence thereon is realized with the following, preferred dimensions which, however, do not restrict the invention, see also in FIG. 1*b* in this respect:

Diameter d1=30 mm,
Diameter d2=30 mm,
Diameter d3=30 mm
Spacing a1=40 mm,
Spacing a12=50 mm,
Spacing a13=214 mm,
Spacing a23=164 mm.

In this case, d1, d2, d3 designate the respective diameter of the conveying rollers 7.1, 7.2, 7.3; a1 the spacing between the left-hand end of the stack 1 and the rotational axis A1 of the first conveying roller 7.1; a12 the spacing between the rotational axes A1 and A2 of the first and of the second conveying roller 7.1 and 7.2; a13 the spacing between the rotational axes A1 and A3 of the first conveying roller 7.1 and of the third conveying roller 7.3 and a23 the spacing between the rotational axes A2 and A3 of the conveying rollers 7.2 and 7.3, the spacings a1, a12, a13 and a23 being measured in each case parallel to the support surface 3.2 on the bottom 3.1 of the support 3.

Figure 2:
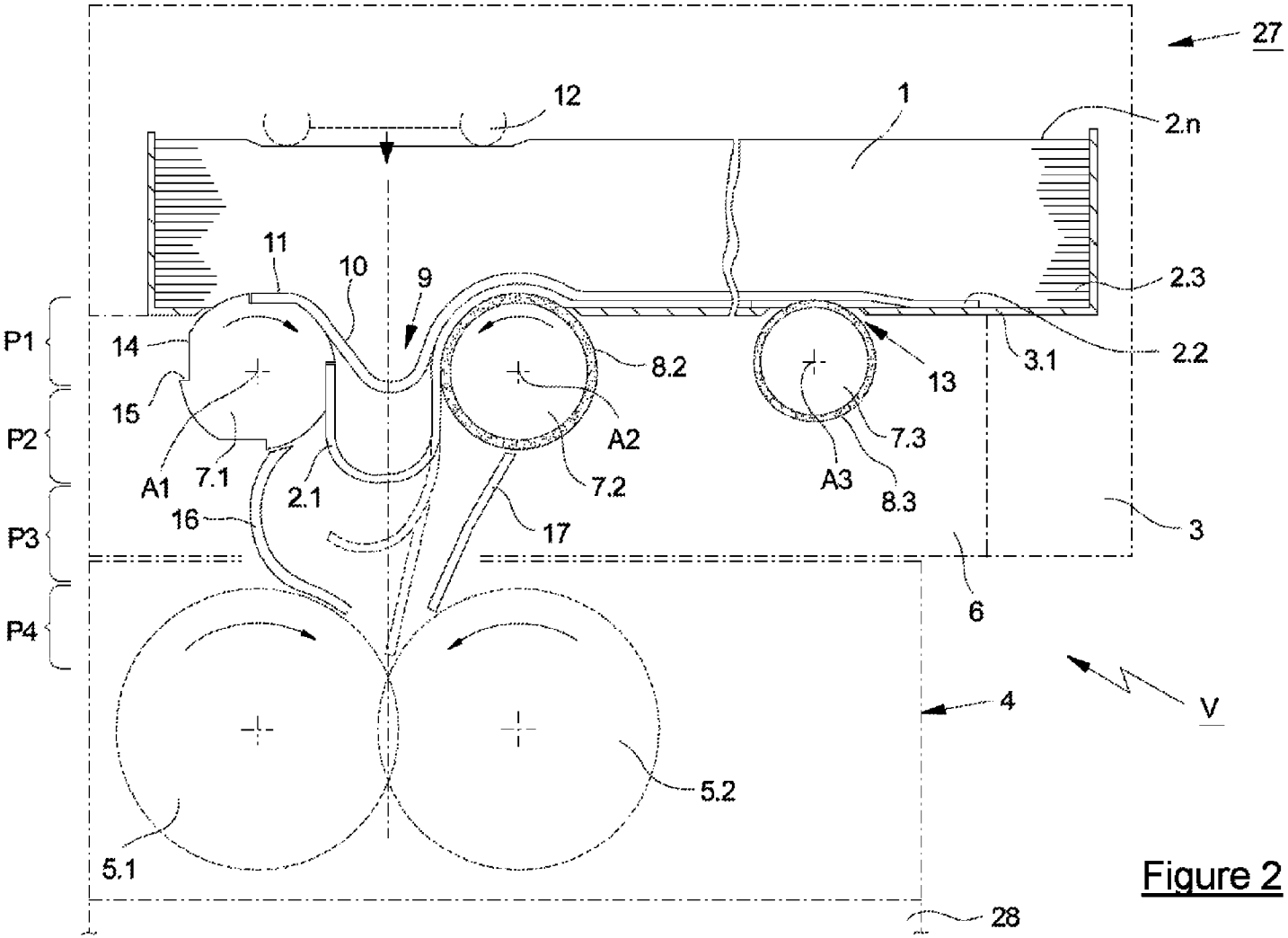
FIG. 2 shows a development of the embodiments according to FIG. 1 and according to FIG. 1*a;*

Deviating from the examples according to FIG. 1, FIG. 1*a* and FIG. 1*b*, in a further development of the new "V" device shown in FIG. 2, the circumferential face of the first conveying roller 7.1 is provided with a surface profile which ensures a form-locking connection to the free ends of the sheets 2.1, 2.2 . . . 2.*n*.

Said profile is realized in the form of recesses 14 which comprise face portions 15 which are aligned perpendicular to the direction of rotation and the height of which corresponds to the thickness of one of the sheets 2.1, 2.2 . . . 2.*n* and which are distributed on the circumference such that with the rotation always one of the face portions 15 grasps the sheet 2.1, 2.2 . . . or 2.*n* to be conveyed in each case by way of its end face and thus contributes compulsorily to the forming of the sheet loop 10.

The remaining components and assemblies of the "V" device are realized just as in the aforementioned exemplary embodiments according to FIG. 1, FIG. 1*a* and FIG. 1*b*, have the identical operating tasks and are accordingly also provided in FIG. 2 with the same references.

With reference to the structural developments of the device according to the invention, it must be noted that, irrespective of its respective embodiment, the spacing a12, see FIG. 1*b*, has a considerable influence on the degree of deformation of the pulled-in sheets 2.1, 2.2 . . . 2.*n*, on the length of the unfolded sheet end 11 and consequently on the position and spacing of the cutting system 4 relative to the sheet-grasping and sheet-conveying device 6. In addition, the force that is necessary for the deforming and consequently the coefficient of friction which is necessary between the conveying rollers 7.1 and 7.2 and the sheets 2.1, 2.2 . . . 2.*n* are also influenced.

The greater the spacing a12, the longer the sheet end 11 after unfolding the sheet loop 10. If the spacing a12 is chosen to be too small, there is the risk of the sheet material deforming in a plastic and irreversible manner, the force necessary for the deformation also being all the greater.

So that the sheet ends 11 unfold again with greater reliability and the sheets 2.1, 2.2 . . . 2.*n* pass into the cutting system 4 with the sheet ends 11 in front, see FIGS. 1, 1*a*, 1*b* and 2, guiding elements 16 and 17 in the form of baffles can be arranged as an option in the feed region/pull-in shaft 18 which is provided in front of the pull-in gap that is formed by the cutting rollers 5.1 and 5.2, preferably with the forms and positions shown in the Figures.

The unfolding length of the sheet end 11 must be taken into consideration for the spacing of the cutting system 4 relative to the sheet-grasping and sheet-conveying device 6. In an advantageous manner, in addition to said unfolding length a security spacing is provided so that the sheet end 11 obtains sufficient space in order to pass freely and in an unobstructed manner into the cutting system 4, which could otherwise result in a sheet jam. The unfolding length is dependent on the period of time that the sheet end 11 requires from being grasped by way of the conveying roller 7.1 to complete unfolding or stretching, as is shown by way of the sequence phase P4.

In an advantageous manner, the conveying rollers 7.1, 7.2 and 7.3 have the identical diameters and the identical circumferential speed. Otherwise different diameters have to be compensated for by different circumferential speeds or vice versa in order to compensate for unwanted stresses in the sheet material or fold formation in the region between the conveying rollers 7.2 and 7.3.

The drive of the conveying rollers 7.1, 7.2 and 7.3 is effected using usual means per se. Within the framework of the invention, according to one possible realization variant, the drive of the conveying rollers 7.1, 7.2 and 7.3 is coupled with the drive unit of the cutting system 4, at least in terms of circuitry, or the drive is preferably effected by the drive unit of the cutting system.

According to one embodiment of the invention, it is also possible to use a separate drive unit which is preferably coupled with a control unit of the "V" device.

Figure 3:
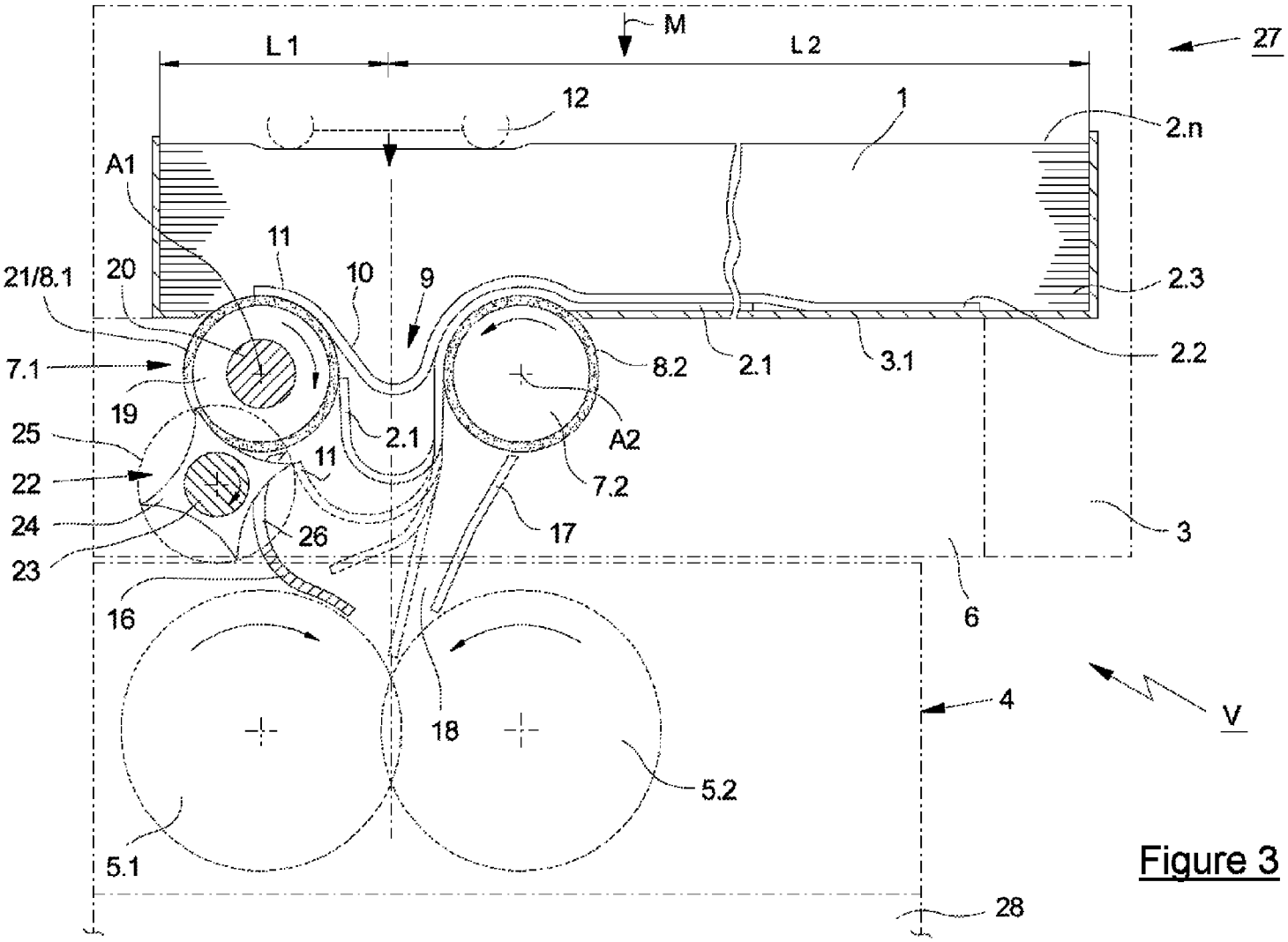
FIG. 3 shows a further development of the embodiment according to FIG. 1

A further exemplary embodiment of the invention is shown in FIG. 3. Said exemplary embodiment proceeds from the exemplary embodiment according to FIG. 1. In this case, the conveying roller 7.1, against which the respective sheet end 11 abuts during the forming of the temporary sheet loop 10, has associated therewith a loop opener 22. Said loop opener 22 consists of a shaft 23 which is arranged at a spacing to and parallel with the axis A1 of the conveying roller 7.1. At least one, preferably several star disks 24 which are axially spaced apart from one another, are fixedly arranged on the shaft 23. The reference 25 in FIG. 3 indicates the turning circle of the ends of the star disks 24 which protrude radially, said turning circle being produced when the shaft 23 rotates. The direction of rotation of the shaft 23, that is of the star disks 24, is the same direction as the direction of rotation of the conveying roller 7.1, which is shown by way of the direction arrow applied on the shaft 23.

The loop opener 22 causes a sheet end 11 which possibly adheres for too long a time to the circumferential face 8.1 of the conveying roller 7.1—regardless for whatever reason—to be pushed to open the loop by each one of the radially projecting ends of the star disks 24. The formed sheet loop 10 is opened in a positive manner.

In an advantageous manner, it is additionally provided that slots 26 are provided in the guide element 16 corresponding to the number and corresponding to the star disks 24 provided, through which slots at least the radially projecting ends of the star disks 24 are able to reach for the purposes of temporary contact with the respective sheet end 11.

It is additionally provided in an advantageous manner that incisions 19, corresponding to the number and corresponding to the star disks 24 provided, are arranged in the body of the conveying roller 7.1, said incisions being radially directed, spaced apart from one another in the axial direction and reaching as far as up to its core shaft 20 such that also the conveying roller 7.1 has several disks 21 or disk-shaped regions.

The rotating star disks 24 of the loop opener 22 can therefore engage in a meshing manner in the conveying roller 7.1 and reach through the guide element 16.

Said further realization variant according to FIG. 3 can also be used with the embodiment variants of the invention according to FIGS. 1*a* and 2.

FIG. 4 shows a further realization variant of the invention. Said realization proceeds initially from the realization variant of the invention according to FIG. 1. A portion 31 of the top region of a housing 30 of the cutting system 4 or a corresponding portion of the bottom region of a housing of the sheet-grasping and sheet-conveying device 6 has a slot-shaped opening 29 which is guided toward the feed region 18 which is arranged in front of the cutting system. As a result of said arrangement, during the automatic feeding of sheet-shaped material by means of the auto-feed unit 27, it is also possible to guide sheet-shaped material additionally toward the cutting system in a manual manner.

As an alternative to this, said two portions can also form or include together the opening 29.

One development of the invention is that at the side of the support surface 3.2 of the support 3 of the auto-feed unit 27 walls 3.3 can be arranged directed upward such that the support 3 is realized as a box, as is shown in FIGS. 1 to 4.

Only the two oppositely located end-face walls 3.3 can be seen in each case in FIGS. 1 to 4. One of the side walls cannot be seen as a result of the sectional representation and the other side wall is covered by the inserted paper stack 1.

In the realization variant shown, the box does not have a cover.

However, it is also within the framework of the invention for a box-shaped support 3 also to be able to have a cover.

In so far as the device is provided for shredding confidential documents, the cover can also be realized so as to be lockable. The locking can be effected with a mechanically operating lock or by a lock which operates in an electro-mechanical manner. Where an electro-mechanically operating lock is used, a PIN code can be input on the lock itself or on a switch and control device of the "V" device, i.e. in the keyboard thereof, by means of which PIN code authorization to open and close the cover of the box can be allocated to certain persons. The variant/variants of the input of the PIN code, corresponding to the further development of electro-mechanical components and of the control technology will be adapted to the current versions of the relevant components and control. Thus, the input of the PIN code can be effected with the connecting of a data carrier to the switch and control device of the "V" device, for example to or in connection with a USB stick or a memory card or a RFID system.

Further realization variants of the invention which have not been shown in the Figures and associated parts of the description and have not been explained in more detail are, on the one hand, that the sheet-grasping and sheet-conveying device 6 and the cutting system 4 together form one structural unit and the support 3 can be placed onto said structural unit. Or that the support 3, the sheet-grasping and sheet-conveying device 6 and the cutting system 4 are realized in each case as modular assemblies such that they are able to be combined together in a selective manner.

In particular the support 3 can consequently be better adapted to the different applications of the "V" device; with regard to its capacity, the paper format, its arrangement/position on the "V" device, for example a relatively horizontal position or an inclined position or similar wishes of the purchaser/user of the "V" device.

Another realization variant consists in that the auto-feed unit 27 that is formed by the support 3 and the sheet-grasping and sheet-conveying device 6 can be adapted to/placed on series document shredders. In this connection, it is provided in an advantageous manner that the drive for the auto-feed 27 is integrated into the same such that the auto-feed unit 27 is able to operate in an autarchic manner.

A further realization variant consist in that the realization variants of the invention described in conjunction with the FIGS. 1 to 4 are supplemented with a unit which is arranged beneath the cutting system 4 and by way of which the shredded particles output by the cutting system 4 fall into the collecting container 28 which is arranged under the cutting system 4 such that the realization of a material cone is avoided. The achievement here is that the volume of the collecting container 28 is better utilized. An otherwise usual intervention in the operating process during operation, such as, for example, temporary removal of the collecting container to eliminate a material cone that has formed is avoided.

The described exemplary embodiments with the developments according to FIGS. 1 to 4 are designed for the processing of sheet-shaped material in the DIN A4 format.

The invention, however, is not restricted to this. Where the dimensions of the components or assemblies are adapted in a corresponding manner, in particular the diameter of the conveying rollers and the spacings between the conveying rollers, using the new method according to the invention and the devices according to the invention it is also possible to shred other sheet formats, e.g. DIN A4 landscape, DIN A3 formats or formats according to US standards.

LIST OF REFERENCES

1 Stack
2.1, 2.2 . . . **2.*n*** sheets
3 Support
3.1 Bottom (of item 3)
3.2 Support surface (on item 3.1)
3.3 Walls (on item 3)
4 Cutting system
5.1, 5.2 Cutting rollers
6 Sheet-grasping and sheet-conveying device
7.1, 7.2, 7.3 Conveying rollers
8.1, 8.2, 8.3 Circumferential faces
9 Through-opening
10 Sheet loop
11 Sheet end
12 Bearing weights
13 Opening
14 Recess
15 Face portions
16, 17 Guide elements
18 Feed region
19 Incisions
20 Core shaft (of item 7.1)
21 Disks
22 Loop opener
23 Shaft
24 Star disks
25 Turning circle (of item 24)
26 Slots (in item 16)
27 Auto-feed unit
28 Collecting container/bottom part/housing
29 Opening (for manual feed)
30 Housing (of item 4)
31 Portion (of item 30)
d1, d2, d3 Diameter
a1, a12, a13, a23 Spacings with reference to the conveying rollers
A1, A2, A3 Axes
L1, L2 Lengths
M Center of the sheet stack (in the longitudinal direction)
P1, P2, P3, P4 Sequence phases
V Device (for shredding sheet-shaped material)

The invention claimed is:

1. A method for shredding a stack of sheets, comprising the following steps:

placing a stack of sheets onto a support, grasping one sheet individually from the stack of sheets through a through-opening in the support to form a sheet loop, conveying the one sheet toward a cutting system, characterized in that when the sheet loop is being formed the one sheet is merely deformed elastically and consequently reversibly, so that the sheet loop is opened thereby forming a free sheet end of the one sheet before the one sheet reaches the cutting system, and the one sheet is introduced into the cutting system with the free sheet end in front, wherein the free sheet end is grasped by the cutting system and pulled into the cutting system such that the one sheet is cut up, unfolded, over its entire length.

2. The method according to claim 1, where the stack of sheets is deposited onto a support surface of the support, and grasping of the one sheet and passage thereof through the through-opening is performed by means of counter rotating conveying rollers, circumferential faces of which move into entraining contact in a positive locking or frictional locking manner with the one sheet.

3. The method according to claim 2 , where the free sheet end is stretched by a loop opener which acts on the free sheet end which is still abutting against one of the counter rotating conveying rollers.

4. The method according to claim 2, further comprising the step of depositing the stack of sheets onto a support surface of the support which is aligned at an angle with respect to the direction of gravity.

5. The method according to claim 2, further comprising the step of depositing the stack of sheets onto a supporting surface of the support which is aligned substantially perpendicular to the direction of gravity.

6. The method according to claim 2, further comprising the step of using a spring or bearing weights to increase a bearing force of the stack onto the counter rotating conveying rollers.

7. The method according to claim 1, where the free sheet end is stretched as a result of gravity acting on the free sheet end.

8. The method according to claim 1, further comprising a step of grasping a second sheet individually from the stack of sheets through the through opening in the support before the free sheet end of the one sheet reaches the cutting system.

9. A device for shredding sheets, comprising:

a support for a stack of sheets, a cutting system including two counter-rotating cutting rollers, a sheet-grasping and sheet-conveying device for grasping one sheet individually from the stack of sheets and for conveying the one sheet toward the cutting system, including two counter rotating conveying rollers having circumferential faces which are in entraining contact with the one sheet through a through-opening which is present in the support, and wherein the through-opening is located at a predefined asymmetrical position relative to the support so that entraining contact of the two counter rotating conveying rollers with the one sheet will form a sheet loop which extends toward the cutting system, and entraining contact of the one sheet with one of the two counter rotating conveying rollers will terminate such that one end of the one sheet is free and the sheet loop will open to present a free sheet end, and the cutting system is positioned relative to the through-opening such that said one sheet passes between the cutting rollers, wherein the sheet is grasped at the free sheet end by the cutting system, pulled into the cutting system by means of the cutting rollers and is cut up over its entire length.

10. The device according to claim 9, where the cutting system is positioned relative to the through-opening so that the free sheet end is pulled by gravity toward the cutting system.

11. The device according to claim 9, further comprising guide elements for the free sheet end are provided between the two counter rotating conveying rollers and the cutting system.

12. The device according to claim 9, further comprising a third rotating conveying roller which is in entraining contact in a positive locking or frictional locking manner with at least one of the sheets of the stack of sheets.

13. The device according to claim 12, wherein the recited elements define the following dimensions:

diameter d1=30 mm, diameter d2=30 mm, diameter d3=30 mm spacing a1=40 mm, spacing a12=50 mm, spacing a13=214 mm, spacing a23=164 mm, where d1, d2, d3 designate a corresponding diameter of the two counter rotating conveying rollers and the third rotating conveying roller, a1 designates a spacing between one end of the stack and a first rotational axis A1 of a first conveying roller of the two counter rotating conveying rollers, a12 a spacing between the rotational axis A1 and a second rotational axis A2 of a second conveying roller of the two counter rotating conveying rollers, a13 a spacing between the rotational axis A1 and a third rotational axis A3 of the third conveying roller and a23 a spacing between the rotational axes A2 and A3.

14. The device according to claim 12, where the two counter rotating conveying rollers are covered with a less hard material, preferably with a soft-elastic material or with rubber, or the circumferential faces of the conveying rollers are realized with a roughness such that a static friction between the two counter rotating conveying rollers and the one sheet is always greater than between the one sheet and the stack of sheets.

15. The device according to claim 12, further comprising a further opening which is present in the support.

16. The device according to claim 12, wherein at least one of the two counter rotating conveying rollers includes an incision, further comprising a star disk with ends which protrude radially and pass through the incision to act on the one sheet.

17. The device according to claim 9, further comprising a spring and/or bearing weights for increasing a pressing force at which the stack of sheets rests on the two counter rotating conveying rollers.

18. The device according to claim 9, where the two counter rotating conveying rollers are covered with a less hard material, preferably with a soft-elastic material or with rubber, or a circumferential face of the two counter rotating conveying rollers are realized with a roughness such that a static friction between the two counter rotating conveying rollers and the one sheet is greater than between the one sheet and the stack of sheets.

19. The device according to claim 9, further comprising a loop opener which acts at times on the one sheet.

20. The device according to claim 9, wherein at least one of the two counter rotating conveying rollers includes an incision, further comprising a star disk with ends which protrude radially and pass through the incision to act on the one sheet.

* * * * *